US006926594B1

(12) United States Patent
Nakayama

(10) Patent No.: US 6,926,594 B1
(45) Date of Patent: Aug. 9, 2005

(54) SHOT BLAST MACHINE

(75) Inventor: Akinori Nakayama, Kashiwa (JP)

(73) Assignee: Nissanki Co., Ltd., Kashiwa (JP)

( * ) Notice: Subject to any disclaimer, the term of this patent is extended or adjusted under 35 U.S.C. 154(b) by 74 days.

(21) Appl. No.: 10/777,445

(22) Filed: Feb. 11, 2004

(51) Int. Cl.[7] ..... B24C 3/00
(52) U.S. Cl. ..... 451/85; 451/89; 451/38; 451/826; 451/828
(58) Field of Search ..... 451/89, 85, 38, 451/326–329; 220/345.1, 135.1; 49/340

(56) References Cited

U.S. PATENT DOCUMENTS 3,041,787 A * 7/1962 Schnetzer ..... 451/82
3,179,341 A * 4/1965 Otto et al. ..... 239/414
4,221,302 A * 9/1980 Kupersmit ..... 220/4.31
5,127,198 A * 7/1992 Nakayama et al. ..... 451/82
5,906,533 A * 5/1999 Harris et al. ..... 451/41
6,431,965 B1 * 8/2002 Jones et al. ..... 451/89
6,467,859 B2 * 10/2002 Branz et al. ..... 312/292
6,607,221 B1 * 8/2003 Elliott ..... 292/33
6,647,665 B1 * 11/2003 Tabrizi et al. ..... 49/340
6,688,946 B2 * 2/2004 Schmidt ..... 451/38
6,749,495 B2 * 6/2004 Grund et al. ..... 451/451

* cited by examiner

*Primary Examiner*—George Nguyen
(74) *Attorney, Agent, or Firm*—Jordan and Hamburg LLP

(57) ABSTRACT

The upper opening which opens the blast-processing chamber can be opened after the door moves slidely to the up and down directions, the door does not project outwardly from the case when the door is opened, it can be installed to the small space. Also it can be prevented to collide against the door.

3 Claims, 14 Drawing Sheets

SHOT BLAST MACHINE

BACKGROUND OF THE INVENTION

This invention relates to a shot blast machine which weld flash produced from a plastic cast, a rubber cast and a die-casting cast are removed by projection of projection material.

The door of the opening for taking product with weld flash in and out to the basket in the blast processing chamber of the conventional shot blast machine is rotated to right-and-left direction in the front side thereof or rotated upward.

For this reason, as an installation space of the shot blast machine, the size at the open state of the door is needed, and a large installation space is needed.

Moreover, the opened door interferes with other work, and it is dangerous.

SUMMARY OF THE INVENTION

Accordingly, it is an object of the invention to provide a shot blast machine which can open the door of the upper opening for taking product with weld flash in and out to the basket in the blast processing chamber without projecting outwardly from the case, and it can install in a small installation space.

It is anther object of the invention to provide a shot blast machine that the door can be opened and dosed comfortably without interfering the opened door with other work and danger.

Novel features which are believed to be characteristic of the invention, both as to its organization and method of operation, together with further objects and advantages thereof are described below with reference to the accompanying drawings in which preferred embodiments of the invention are illustrated as an example.

It is to be expressly understood, however, that the drawings are for the purpose of illustration and description only, and are not intended as a definition of the limits of the invention.

DETAILED DESCRIPTION OF THE PREFERRED EMBODIMENTS

Figure 1:
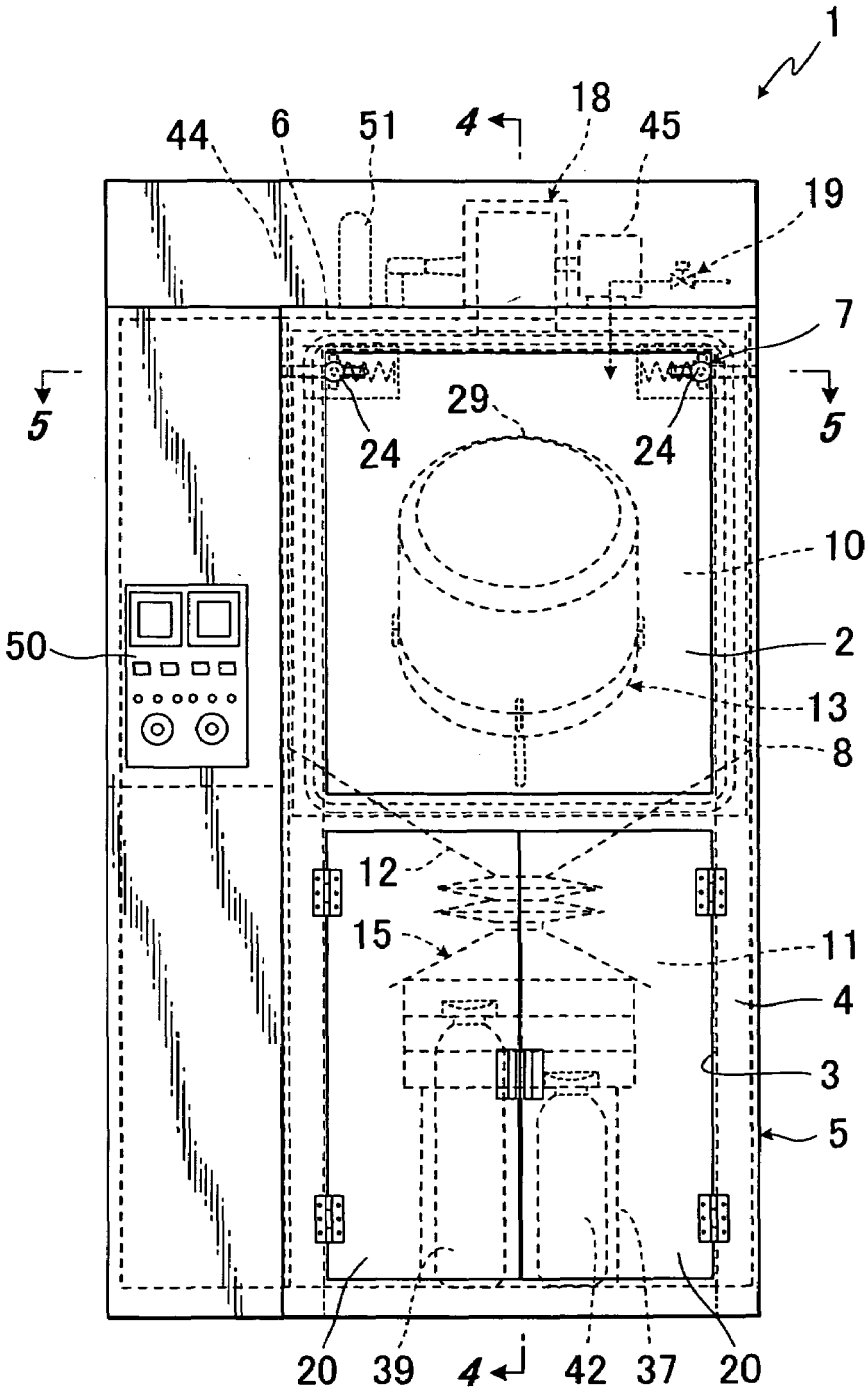
FIG. 1 is a front view showing a first embodiment of the present invention.
Figure 2:
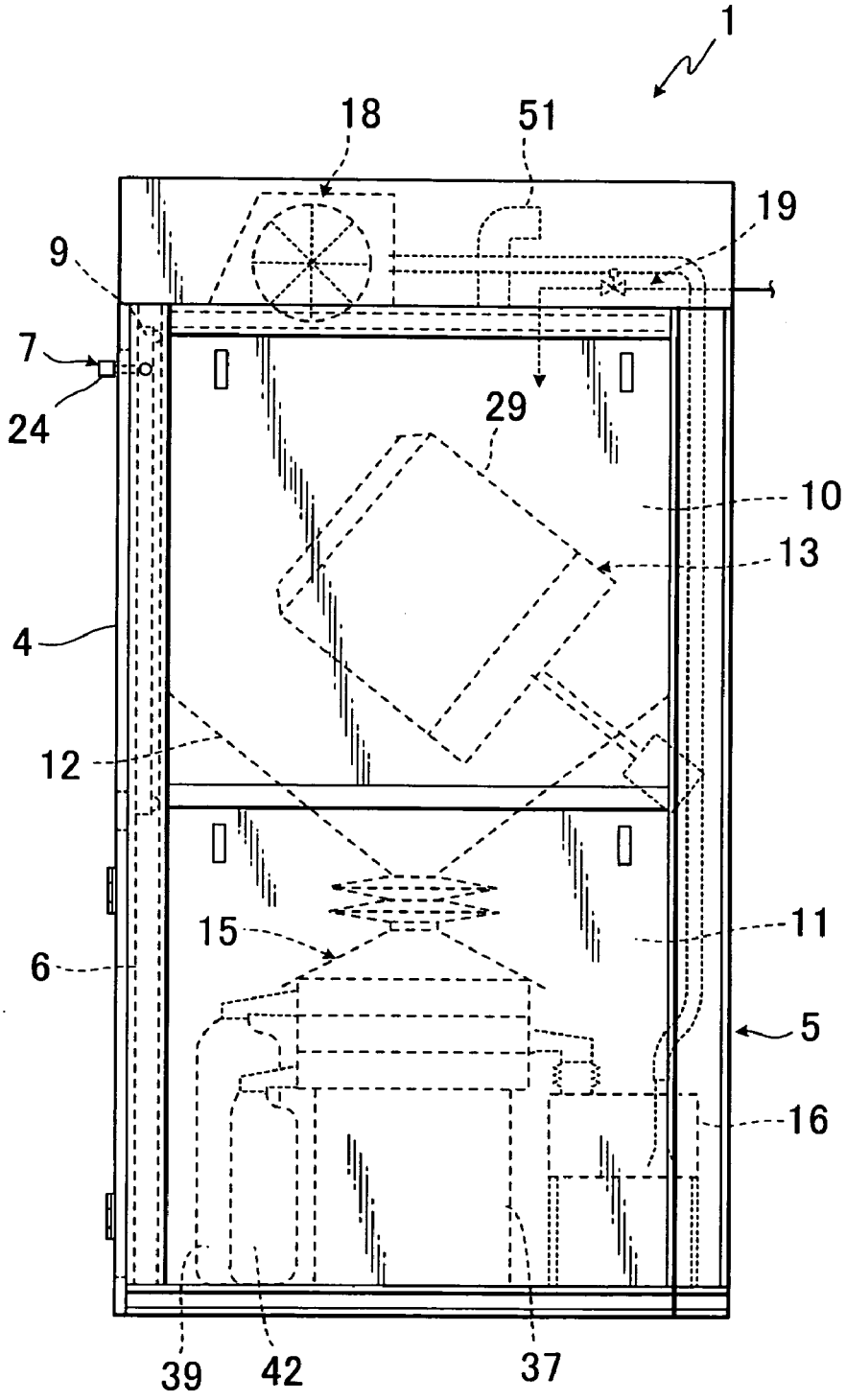
FIG. 2 is a side view.
Figure 3:
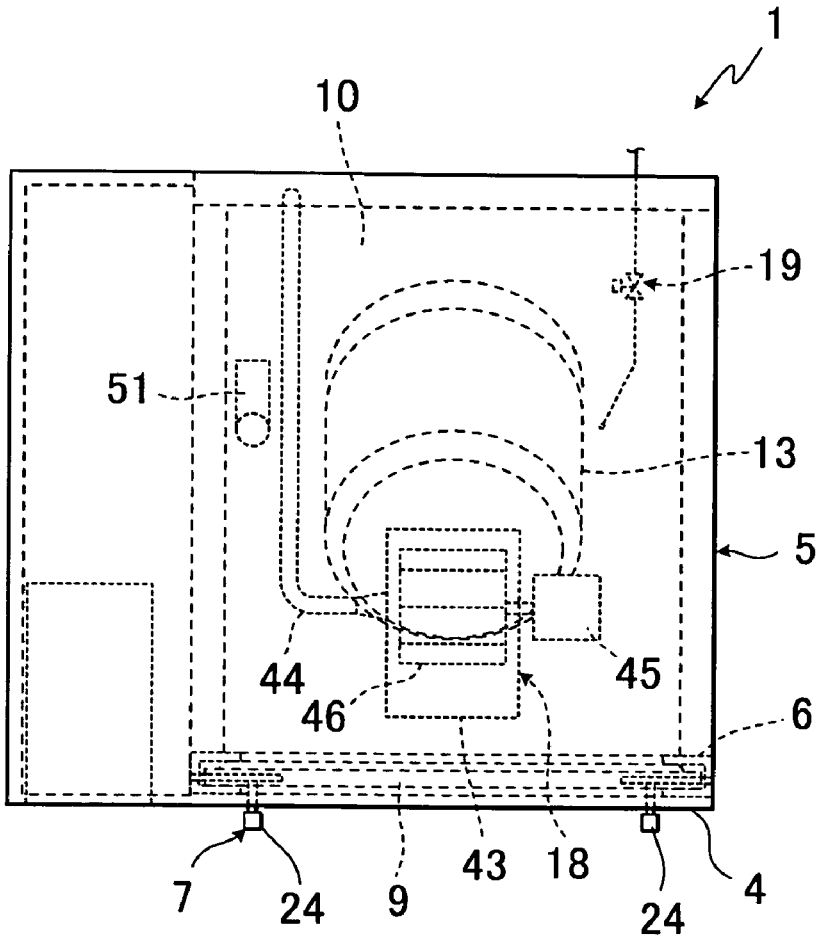
FIG. 3 is a plan view.
Figure 4:
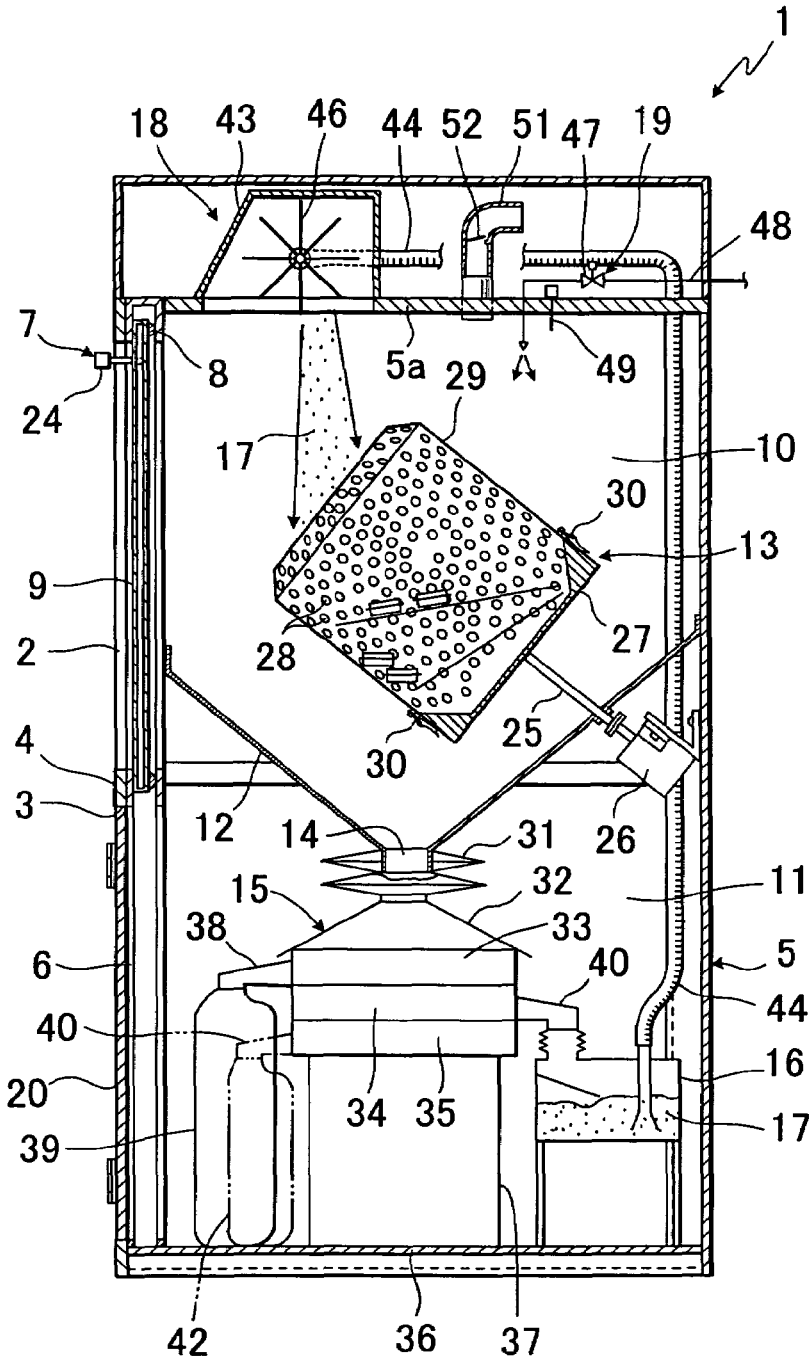
FIG. 4 is a cross sectional view taken along a line 4—4 of FIG. 1.
Figure 5:
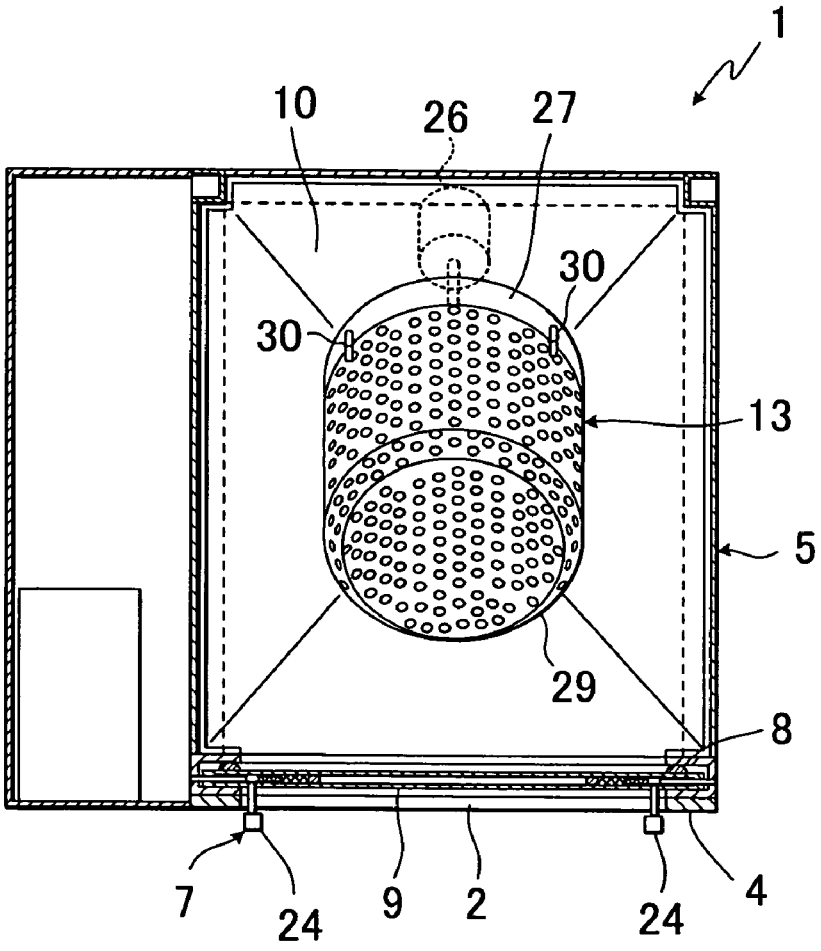
FIG. 5 is a cross sectional view taken along a line 5—5 of FIG. 1.
Figure 6:
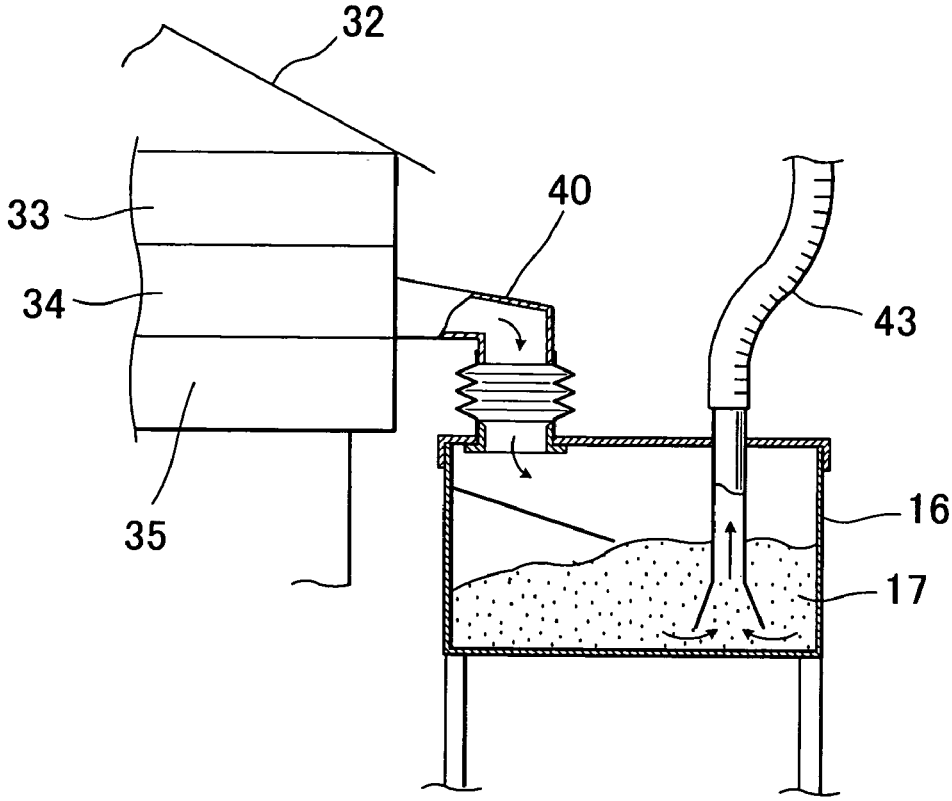
FIG. 6 is an explanation view of a suction part for projection material.
Figure 7:
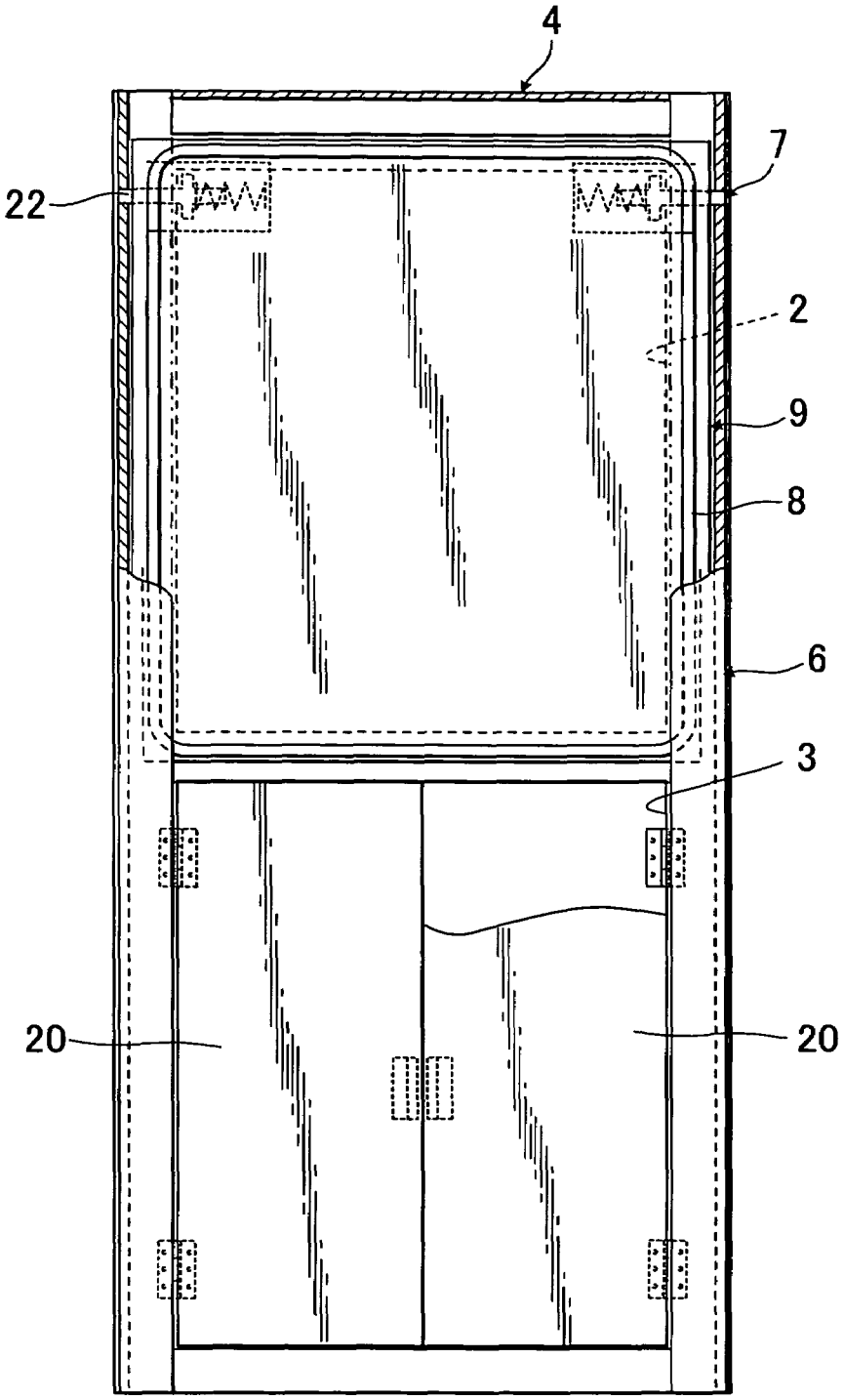
FIG. 7 is a back view of a front panel.
Figure 8:
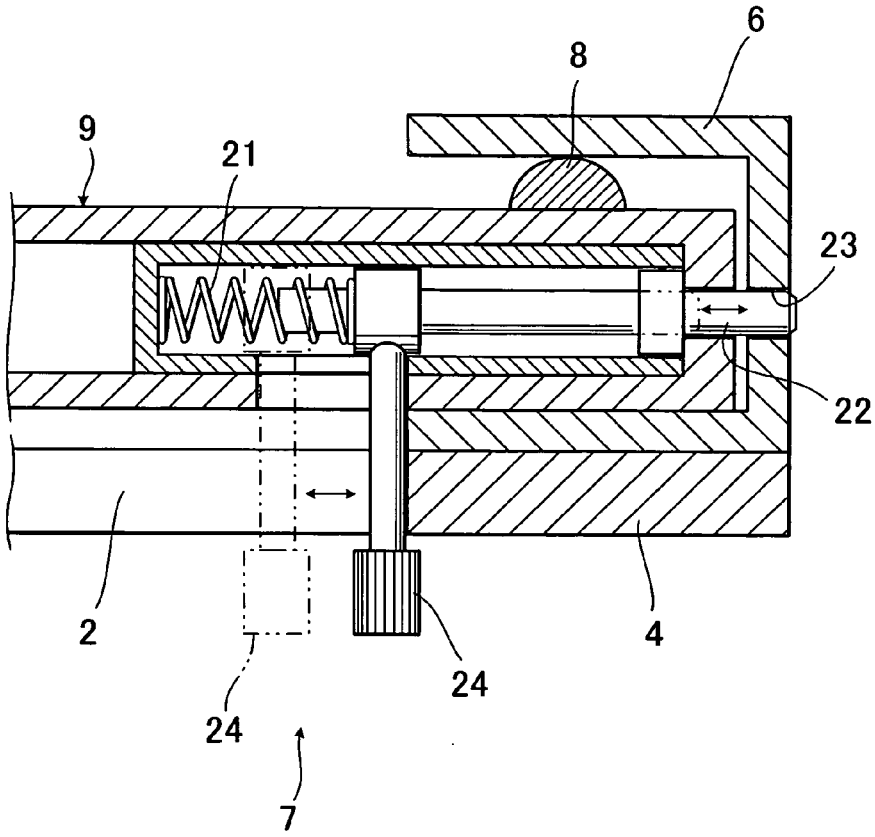
FIG. 8 is an explanation view of a support mechanism.
Figure 9:
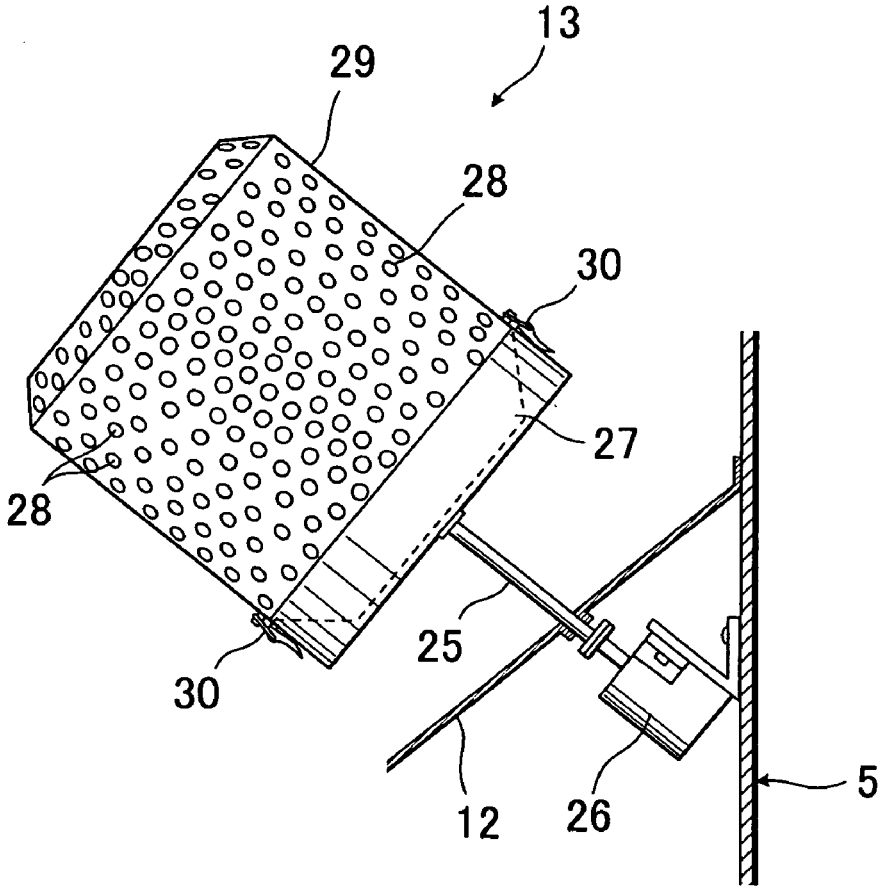
FIG. 9 is an explanation view of a support device for product with weld flash.

Preferred embodiments of the present invention are described in more detail below with reference to the accompanying drawings.

FIGS. 1–9 illustrate a shot blast machine in accordance with a first embodiment of the present invention.

The numeral 1 shows a shot blast machine which is comprised a case 5 having a front panel 4 with openings 2, 3 formed at upper and lower portions thereof a support frame 6 for door; a door 9; a partition wall 12; a support device 13 for the goods which is removed the weld flash; a picking device 15; a projector 18 and a refrigerant supply device 19.

The support frame 6 for the door is formed in the shape of a gate and is made of a channel material. It is attached to a back surface of the front panel 4 of the case 5 and supports the door which opens up the upper opening 2 after it moves slidely downward.

The door 9 is attached to the support frame 6 sidably to the upper and lower directions through a packing 8 which is supported by a support mechanism 7 at a state that the upper opening 2 is dosed.

The partition wall 12 is formed in the shape of a hopper and fenced off so as to characterize the upper part of the case 5 as a blast-processing chamber 10 and the lower part thereof as a processing chamber 11 for projection material.

The support device 13 is attached to the case 5 so as to rotate into the blast-processing chamber 10 while the product with weld flash is supported.

The picking device 15 is installed into the processing chamber 11 and selects the projection material and weld flash which full from a discharging hole 14 which is located at a center portion of the partition wall 12.

The projector 18 is attached to the upper part of the case 5 so as to project a projection material 17 to the product with weld flash supported by the support device 13 after the projection material 17 in a container 16, which contains the projection material, of the processing chamber 11 is suck in.

The refrigerant supply device 19 supplies the refrigerant into the blast-processing chamber 10.

Double doors opening outward 20, 20 are attached to the lower opening 3 of the front panel 4.

The support mechanism 7 is comprised of a pair of engage pins 22, 22 which are attached to both sides of the parts adjacent the upper part of the door 9 and bias so as to project outwardly by a spring 21 respectively; engage holes 23, 23 which are formed at the support frame 6 respectively and lock the tip portions of the engage pins 22, 22 thereinto respectively; and control levers 24, 24 fixed to the back end portion of the engage pins 22, 22, capable of moving to a releasing direction of the engaging state for the engage holes 23 and the engage pins 22.

The support device 13 is comprised of a rotate shaft 25 attached rotatably to the partition wall 12; a motor 26 attached to the case 5 of the processing chamber 11, capable of driving the shaft 25; a support member 27 for a basket 29 attached to tip portion of the shaft 25, formed in the shape of a shallow dish; the basket 29 supported detachably by the support member 27, storing the product with weld flash, defining a perforated plate having a plurality of through holes 28 which is capable of passing the projection material 17 thereinto; and a plurality of mounting brackets 30, 30, 30 capable of attach detachably the basket 29 to the support member 27.

The picking device 15 is comprised of a sieve machine 33 for weld flash which is covered by a cover body 32 which is formed via an accordion 31, made of heat insulator, which is fixed by the partition wall 12, positioned under the discharging hole 14 of the partition wall 12, and picking the weld flash which is larger than the projection material 17; a sieve machine 34 for projection material which is provided at the lower portion of the sieve machine 33, and picking the projection material 17; a dust container 35 which is provided at the lower portion of the sieve machine 34, and storing dust including small weld flash which is smaller than the projection material 17; a vibrator 37 working in conjunction with the projector 18, and vibrating the dust container 35, sieve machine 34 and sieve machine 33 so as to support the dust container 35; a storage bag 39 installed into the processing chamber 11, storing the weld flash which is picked by the sieve machine 33 through a discharging pipe 38; an exhaust pipe 40 which exhausting the projection material 17 which is picked by the sieve machine 34 to the container 16; and a storage bag 42 installed into the processing chamber 11, storing the weld flash which is stored into the dust container 35 through an exhaust pipe 41.

The projector 18 is comprised of a case body 43 having the insulated construction, attaching to the upper wall 5*a* of the blast-processing chamber 10; and an impeller 46 which is attached to an case body 43 so as to suck the projection material 17 in the container 16 through an suction tube 44, rotating by a motor 45.

The refrigerant supply device 19 is comprised of a refrigerant supply pipe 48 installed into the blast-processing chamber 10, interposed a solenoid valve 47 and supplied inert gas including liquid nitrogen, liquid carbon dioxide and the like; a temperature sensor 49 which measures the temperature in the blast-processing chamber 10; a controller 50 which control opening and dosing the solenoid valve 47 and supplying amount of refrigerant; an exhaust pipe 51 attached to the upper wall 5*a* of the blast-processing chamber 10, releasing evaporative gas of the blast-processing chamber 10 into the atmosphere; and a block member 52 installed into the exhaust pipe 51, preventing to flow gas in the blast-processing chamber 10.

In the shot blast machine 1, the upper opening 2 of the front panel 4 is opened by moving slidely the door 9 downward to the processing chamber 11. Then, the user may throw the product with weld flash into the basket 29 or take the product without weld flash from the basket 29.

When the removing of weld flash is performed, the products with weld flash is supplied into the basket 29, and the upper opening 2 is dosed after the door 9 moves slidely upward.

In this state of things, the projector 18, vibrator 37 and motor 26 work by turning on a switch 53 at the same time.

By such operation, suction power acts by the rotation of the impeller 46 of the projector 18, and the projection material 17 in the container 16 is sucked through the suction tube 44. After that, the product with weld flash in the basket 29 is removed the weld flash by projecting the projection material 17 by the impeller 46.

For example, when the product with weld flash is plastic goods molding and rubber molding which embrittles by making it low temperature, the blast-processing chamber 10 is cool down with working the refrigerant supply device 19 and the weld flash is removed.

In this case, refrigerant cycles into the blast-processing chamber 10, picking device 15, container 16, suction tube 44 and projector 18 in turn so that it is used efficiently.

Moreover, in the die-casting cast without embrittlement by making it low temperature, the refrigerant supply device 19 is stopped or used in controlling so as to set at normal temperature.

The projection material 17 which is thrown into the basket 29 comes down from the basket 29 with the removed weld flash, and they come down into the picking device 15 from the discharging hole 14 of the partition wall 12. Then they are selected to the large weld flash, projection material 17 and dust including the weld flash. The large weld flash is stored into the storage bag 39, the projection material 17 is stored into the container 16, and the dust including the weld flash is stored into the storage bag 42.

When the switch 53 turns off after the weld flash of product is removed by projecting the projection material, the projector 18, vibrator 37 and motor 26 stop at the same time.

For this reason, the projection material 17 which is projected by the projector 18 remains into the picking device with the weld flash without moving until next work is started, and the projection material 17 does not remain into the container 16 more than needs.

Other embodiments of the present invention will now be described with reference to FIGS. 10–14. In FIGS. 10–14, the same components as in the first embodiment described above with reference to FIGS. 10–14 are designated by the same reference numerals and therefore will not be further explained in great detail.

Figure 10:
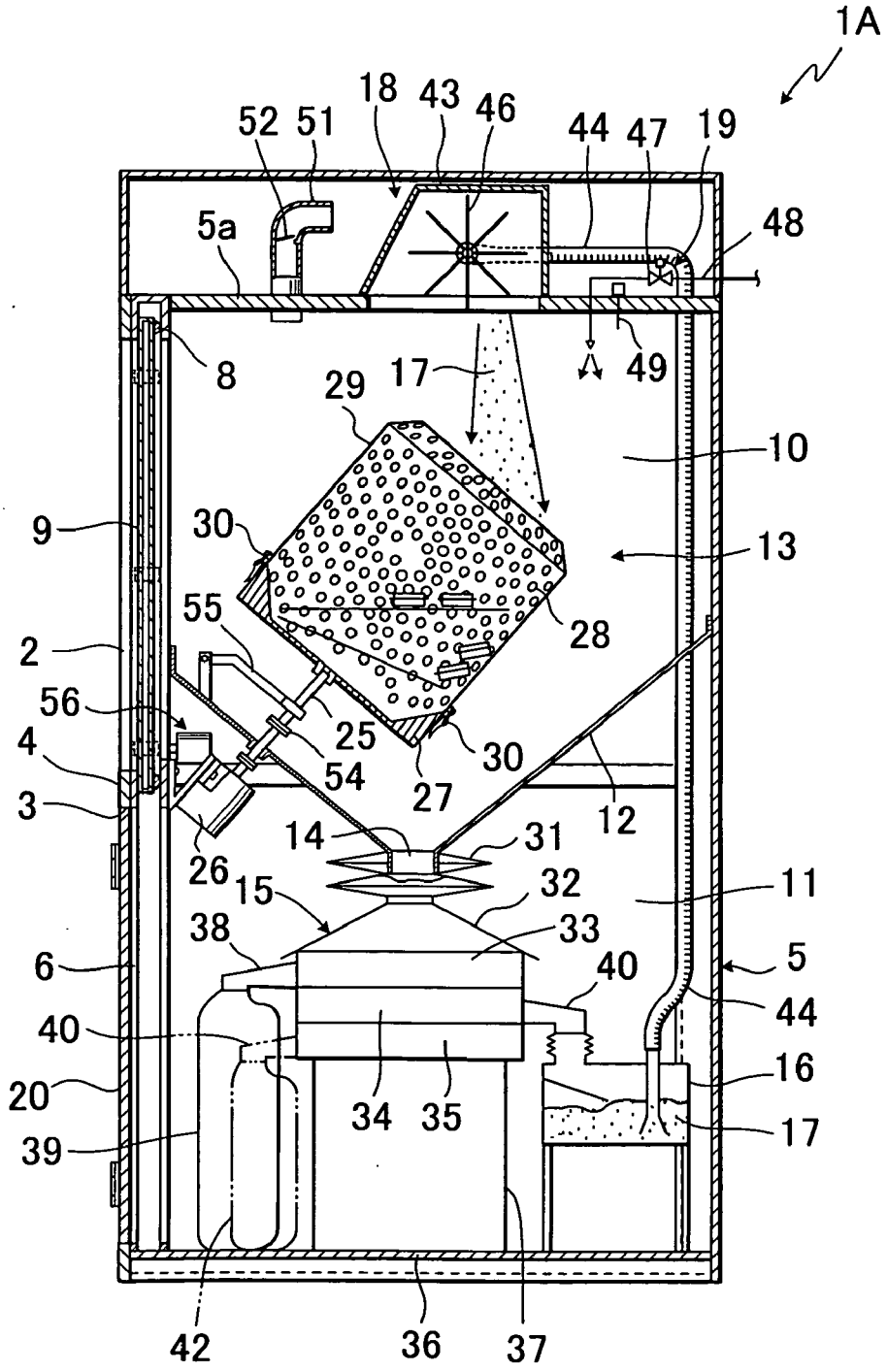
FIG. 10 is a longitudinal sectional view showing a second embodiment of the present invention.
Figure 11:
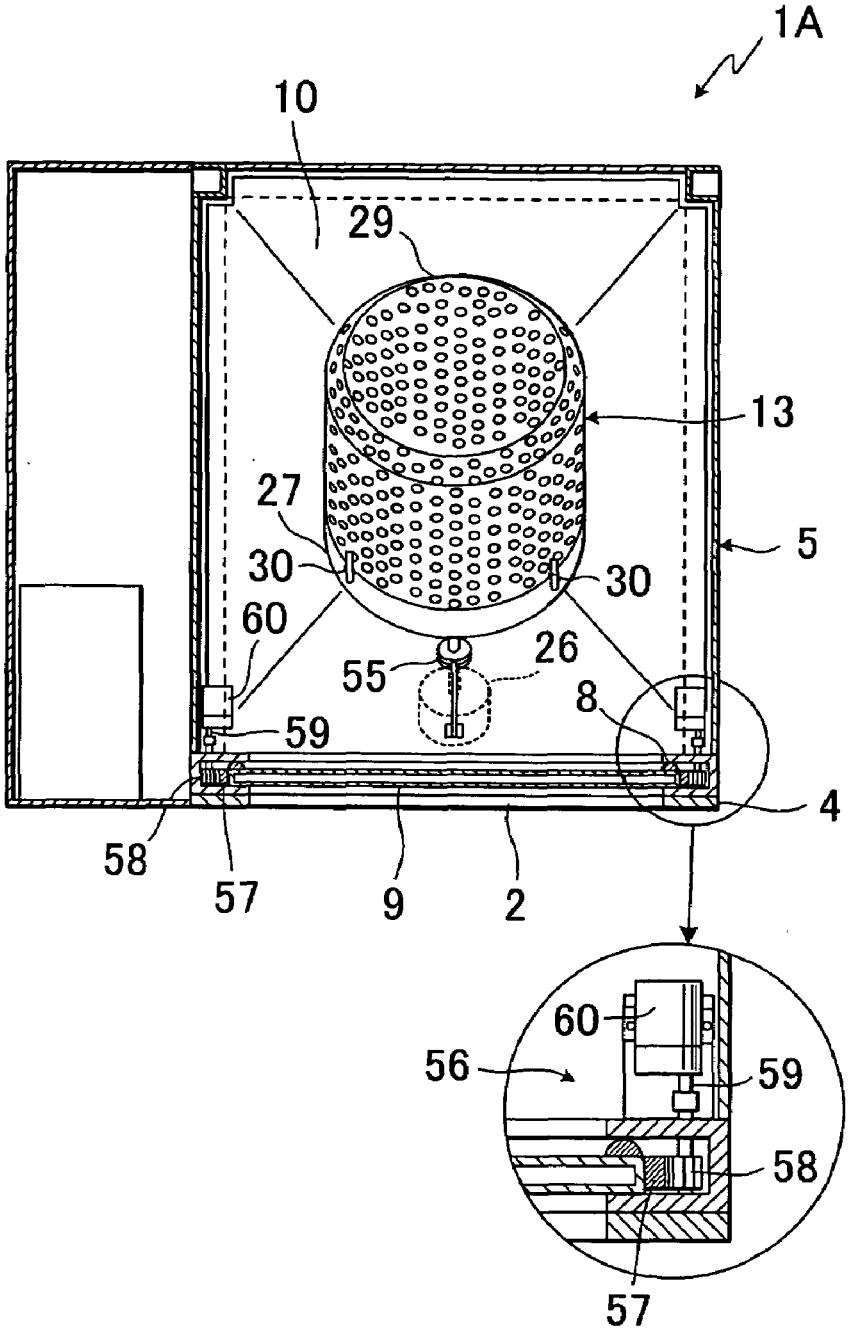
FIG. 11 is a vertical sectional view.
Figure 12:
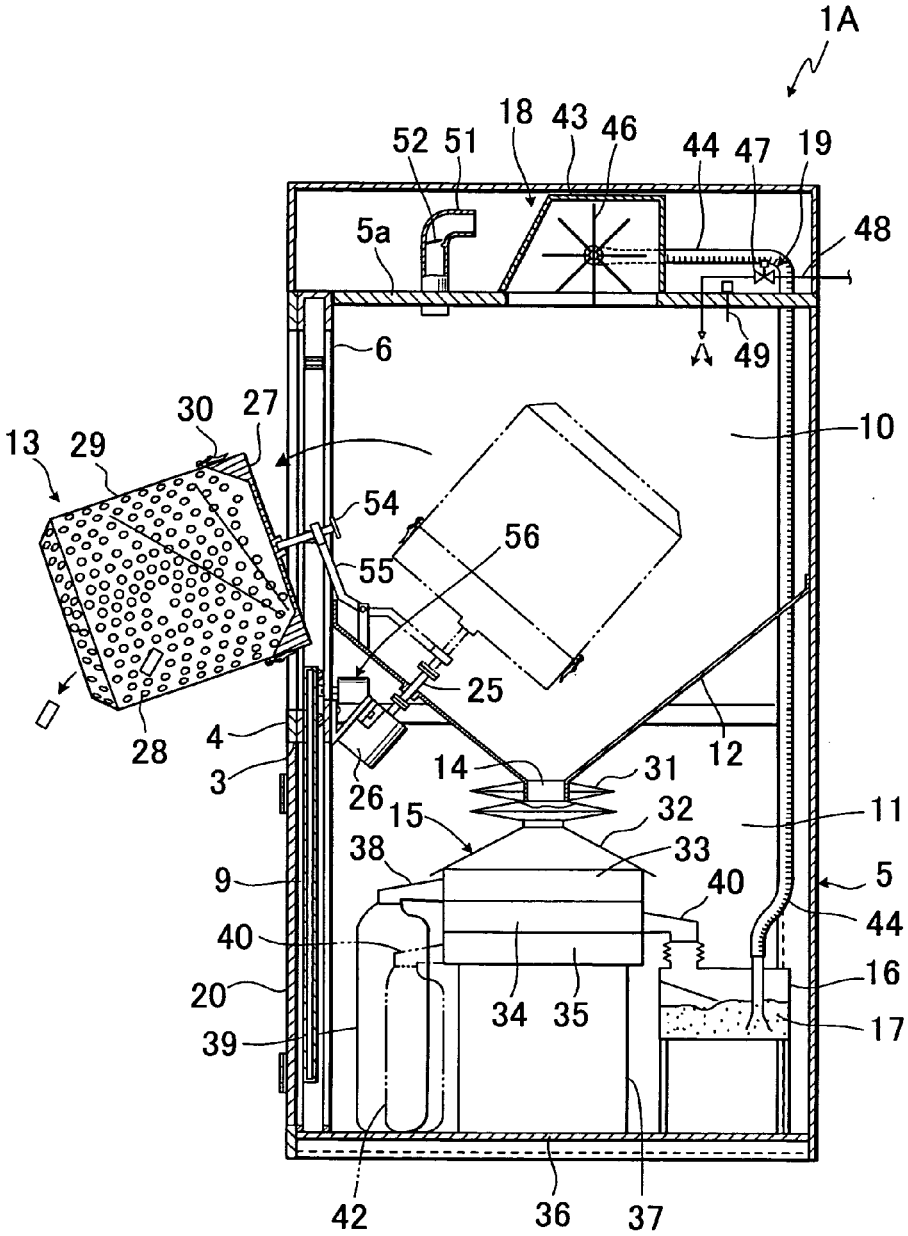
FIG. 12 is an explanation view showing the way in which a support device for the weld flash is taken outwardly.

A second embodiment of the present invention is shown in FIGS. 10–12. It is distinguished from the first embodiment in that a clutch 54 and an attachment 55 are installed to the shaft 25 so as to rotate the basket 29 outwardly such that the product without the weld flash is exhausted from the upper opening 2, and a door automatic device 56, capable of opening and closing the door 9 is used. A shot blast machine 1A according to the second embodiment has similar advantages to that according to the first embodiment. Moreover, the product without the weld flash is taken easily from the basket 29.

In the door automatic device 56, racks 57, 57 are fixed to both sides of the door 9, and pinions 58, 58 are attached to the corresponding position of both sides of the support frame 6. Then the pair of pinions 58, 58 which installed to the lower part of the upper opening 2 is fixed to a driving shaft 59, and a reversible motor 60 is used in which the driving shaft 59 rotates positively and reversibly. Therefore, the door 9 can open and close by acting the reversible motor 60.

Figure 13:
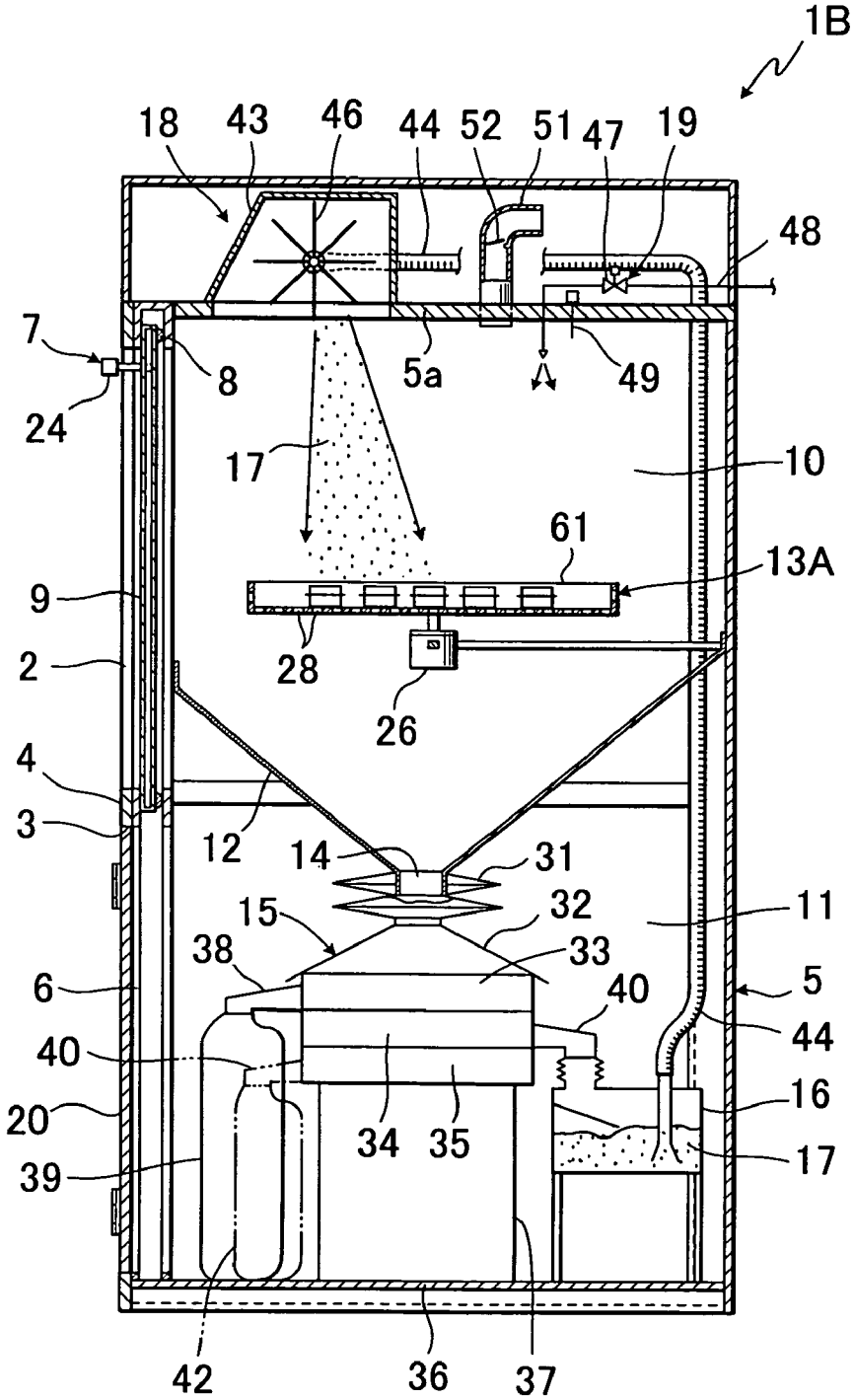
FIG. 13 is a longitudinal sectional view showing a third embodiment of the present invention.
Figure 14:
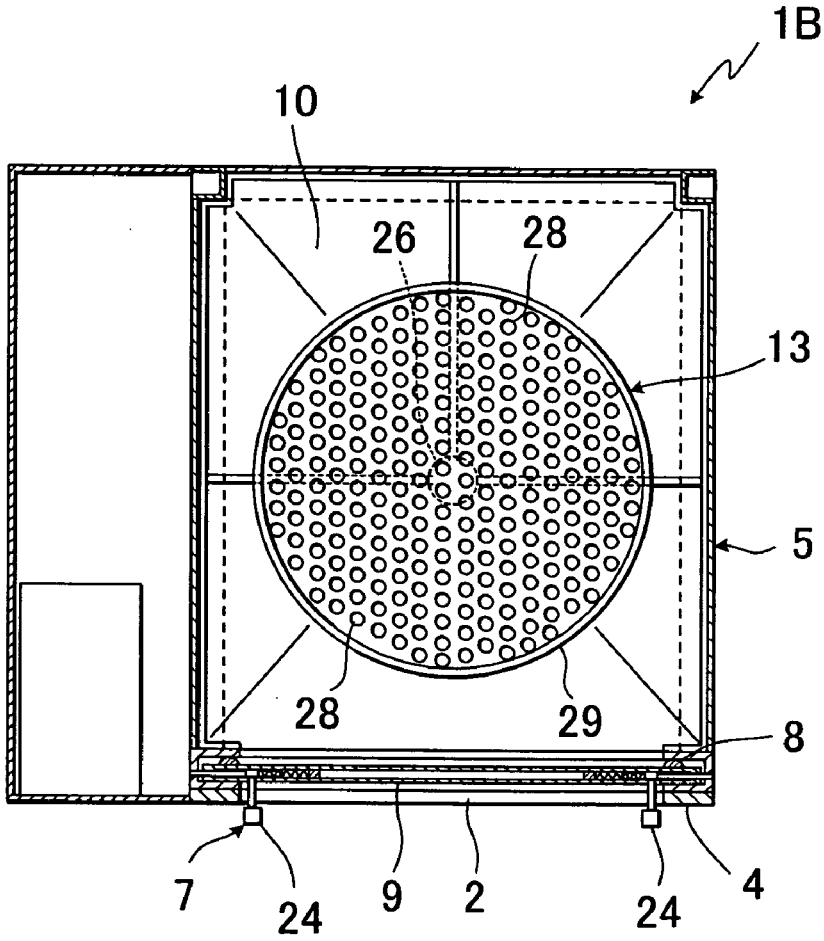
FIG. 14 is a vertical sectional view.

A third embodiment of the present invention is shown in FIGS. 13 and 14. It is distinguished from the first embodiment in that a support device 13A is installed into the blast-processing chamber 10. The support device 13A is comprised of a rotary table 61 formed into the a shallow dish, having the plurality of through holes 28; and the motor 26 rotating the rotary table 61. A shot blast machine 1B with the support device 13A according to the third embodiment has similar advantages to that according to the first embodiment.

As set forth above, the advantages of the invention are as follows:

(1) The shot blast machine includes a support frame for a door, attaching to a back surface of the front panel of the case and supporting the door which opens up the upper opening after it moves slidely in a downward direction; and a door which is attached to the support frame sidably to the upper and lower directions, supporting at a state that the upper opening is closed so that the upper opening which opens the blast-processing chamber can be opened after the door moves slidely to the upward direction.

Therefore, it is unnecessary to occupy the large space, and it can be installed to the small space.

(2) As discussed above, since the door does not project outwardly from the case when the door is opened, it can be prevented to collide against the door.

(3) The shot blast machine includes a partition wall which is formed in the shape of a hopper and fenced off so as to characterize the upper part of the case as a blast-processing chamber and the lower part thereof as a processing chamber for projection material; a support device attached to blast-processing chamber so as to rotate while the product with weld flash is supported; a picking device which is installed into the processing chamber, selecting the projection material and weld flash which fall from the partition wall; and a projector which is attached to the case so as to project a projection material to the product with weld flash which is supported by the support device after the projection material which is selected by the picking device is suck in. Therefore, the refrigerant can be cycled into the blast-processing chamber, picking device and projector in turn.

Therefore, the weld flash of the product can be removed by using less projection material and small machine.

What is claimed is:

1. A shot blast machine comprising:

a case having a front panel with openings formed at an upper and a lower portions thereof;

a door a support frame for the door, attaching to a back surface of the front panel of the case and supporting the door which opens up the upper opening after it moves slidely to a downward direction;

the door which is attached to the support frame slidably to the upper and lower directions, supporting at a state that the upper opening is closed;

a partition wall which is formed in the shape of a hopper and fenced off so as to characterize the upper part of the case as a blast-processing chamber and the lower part thereof as a processing chamber for projection material;

a support device attached to blast-processing chamber so as to rotate while the product with weld flash is supported;

a picking device which is installed into the processing chamber, selecting the projection material and weld flash which fall from the partition wall; and a projector which is attached to the case so as to project a projection material to the product with weld flash which is supported by the support device after the projection material which is selected by the picking device is suck in.

2. A shot blast machine according to claim 1, wherein the door further includes a door automatic device, capable of opening and closing the door automatically.

3. A shot blast machine according to claim 1, further comprising:

a refrigerant supply device which supplies a refrigerant into the blast-processing chamber.

* * * * *